US007270550B1

(12) United States Patent
Peng

(10) Patent No.: US 7,270,550 B1
(45) Date of Patent: Sep. 18, 2007

(54) BOARD TO BOARD CONNECTOR

(75) Inventor: Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/483,718

(22) Filed: Jul. 11, 2006

(51) Int. Cl.
*H01R 13/24* (2006.01)

(52) U.S. Cl. ..... 439/66; 439/700

(58) Field of Classification Search ..... 439/700, 439/66, 288, 287, 69, 74, 482, 862, 824; 324/754
See application file for complete search history.

(56) References Cited

U.S. PATENT DOCUMENTS 5,308,252 A * 5/1994 Mroczkowski et al. ..... 439/66
5,957,703 A * 9/1999 Arai et al. ..... 439/66
6,062,871 A * 5/2000 Arai et al. ..... 439/66
6,358,097 B1 * 3/2002 Peters ..... 439/700
6,405,567 B1 * 6/2002 Loeb et al. ..... 65/415
6,752,386 B1 * 6/2004 Bundy ..... 256/65.12
6,783,405 B1 * 8/2004 Yen ..... 439/824
6,935,901 B2 * 8/2005 Simpson et al. ..... 439/700
6,967,492 B2 * 11/2005 Tsui et al. ..... 324/754
7,040,935 B2 * 5/2006 Wei ..... 439/700
7,112,103 B2 * 9/2006 Zhang et al. ..... 439/700
7,122,103 B2 * 10/2006 Isitani et al. ..... 204/425
7,144,278 B2 * 12/2006 Le Gallic et al. ..... 439/700
2004/0053538 A1 * 3/2004 Villain ..... 439/700

* cited by examiner

*Primary Examiner*—Alexander Gilman
(74) *Attorney, Agent, or Firm*—Birch, Stewart, Kolasch & Birch, LLP

(57) ABSTRACT

A board to board connector includes a dielectric housing and a plurality of terminals. The dielectric housing has an upper surface, a bottom surface and a plurality of terminal passages which pass through the upper surface and the bottom surface. Each terminal is received in each terminal passage respectively. Each terminal has a fixed holding portion. A compressed portion extends from the lower end of the fixed holding portion. The compressed portion has a second contact portion protrudes out from the bottom surface of the dielectric housing. A winding portion extends from the upper end of the fixed holding portion. A first contact portion extends from the top of the winding portion and protrudes out from the upper surface of the dielectric housing. The board to board connector utilizes the elastic force which is supplied by the compressed portion and the winding portion to ensure the terminals contact printed circuit boards stably so as to assure the transmitting of the signal is stably.

7 Claims, 5 Drawing Sheets

BOARD TO BOARD CONNECTOR

BACKGROUND OF THE INVENTION

1. Field of the Invention

The present invention relates to a connector, and particularly to a board to board connector.

2. The Related Art

The terminals of a board to board connector are arranged very densely in the information technology, particularly to the development of portable electronic devices with multiple function. Therefore, in order to make the transmission of the signal being correct and stable, the structure, assembling and the contact method of terminals are very important.

A conventional board to board connector usually utilizes the terminals welding with printed circuit boards to achieve successful transmission of the signal. However, because of the dense arrangement of the terminals, the adjacent terminals are easy to connect with each other. In this case, it will be easy to conduct short-circuits. Therefore, the transmission of the signal will be unsuccessful. Furthermore, the board to board connector is uneasy to disassemble due to the dense arrangement. So that if a part of the board to board connector is damaged, the complete board to board connector will be damaged at once and be out of use.

SUMMARY OF THE INVENTION

The object of the present invention is to provide a board to board connector which could ensure the transmission of the signal is stable and the assemble of the connector is convenient.

In order to achieve the functions just as described, a board to board connector which includes a dielectric housing and a plurality of terminals is provided. The dielectric housing has an upper surface, a bottom surface and a plurality of terminal passages which pass through the upper surface and the bottom surface. The terminals are received in the terminal passages. Each terminal has a fixed holding portion. A compressed portion extends from the lower end of the fixed holding portion. The compressed portion has a second contact portion which protrudes out of the bottom surface of the dielectric housing. A winding portion extends from the upper end of the fixed holding portion. A first contact portion which protrudes out of the upper surface of the dielectric housing extends from the winding portion.

As described in the above, the board to board connector utilizes the elastic force which is supplied by the compressed portion and the winding portion to ensure the terminals contact printed circuit boards stably. Therefore, the transmission of the signal between the printed circuit boards will be assured. Furthermore, the board to board connector is easily disassembled for preventing the connector being out of use when a part of the board to board connector is damaged.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof and wherein.

DETAILED DESCRIPTION OF THE PREFERRED EMBODIMENT

Detailed description will hereunder be given of the preferred embodiment of a board to board connector according to the present invention with reference to the accompanying drawings.

Figure 1:
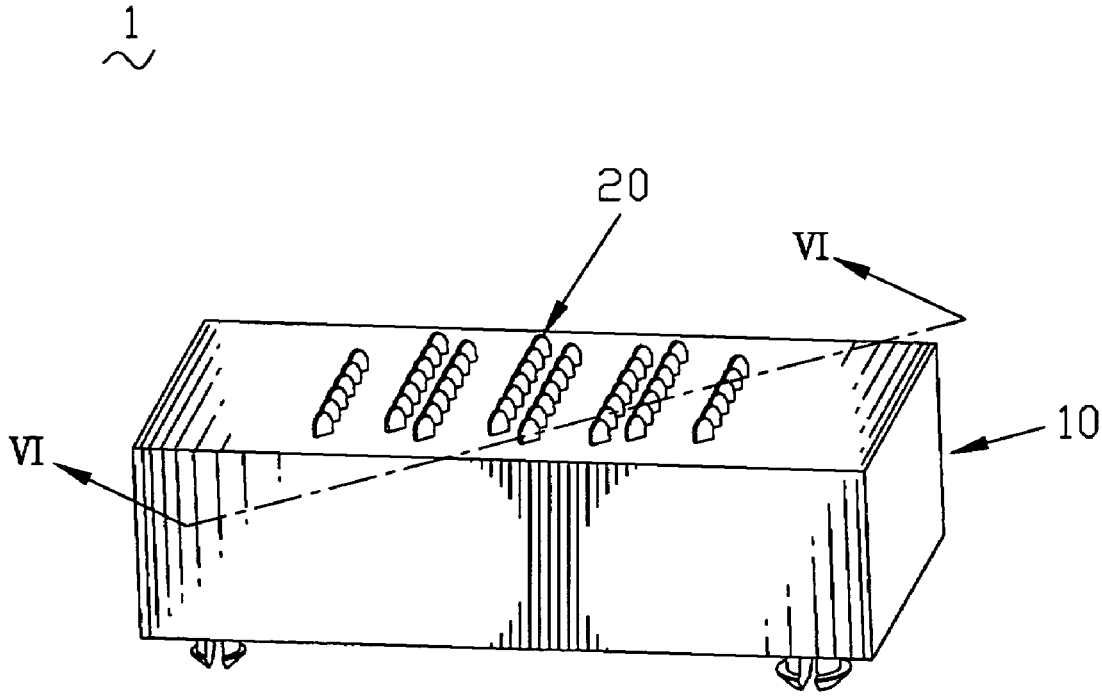
FIG. 1 is a perspective view of a board to board connector according to the invention.

Please refer to FIG. 1. A board to board connector 1 according to the present invention includes a dielectric housing 10 and a plurality of terminals 20 which are received in the dielectric housing 10.

Figure 2:
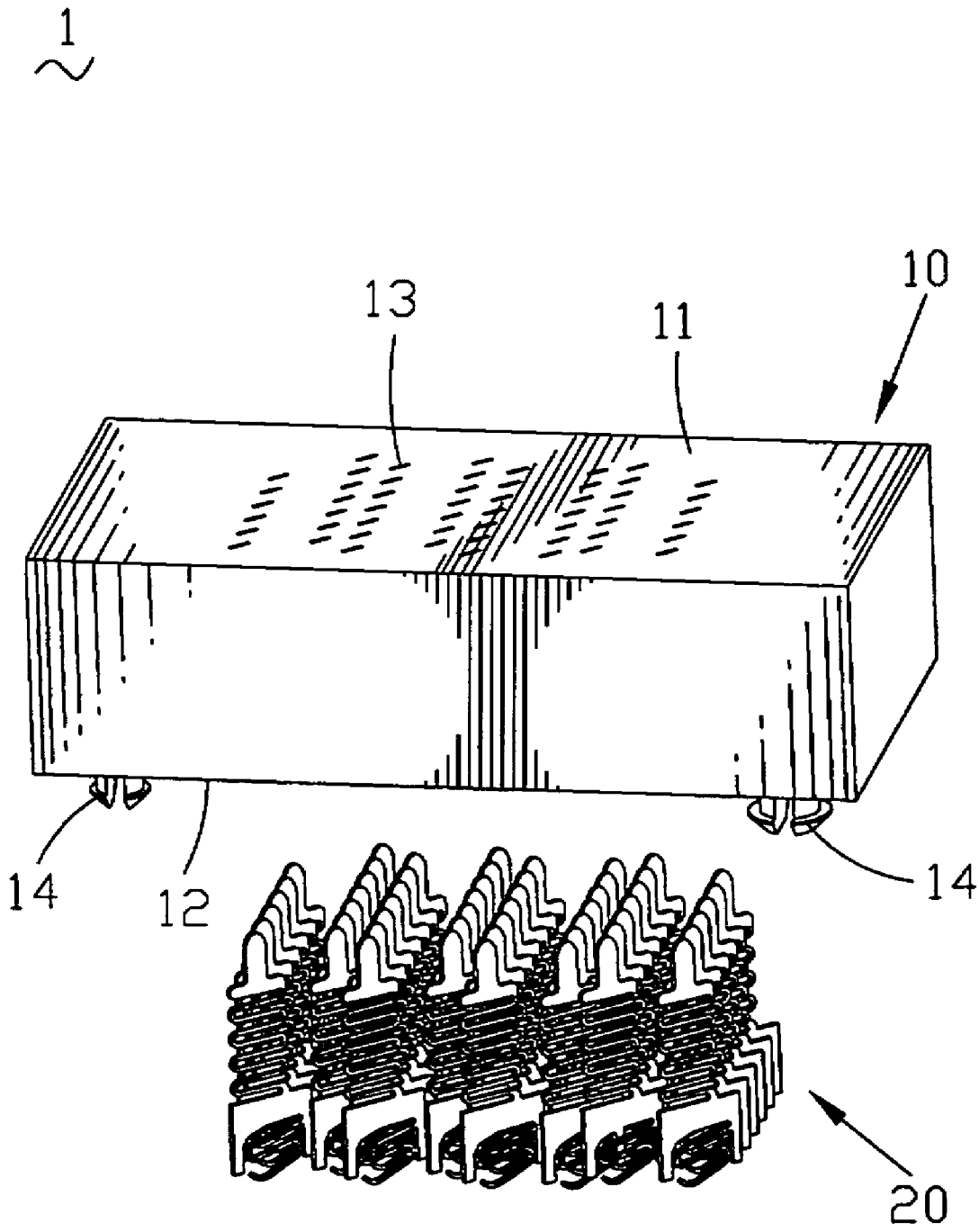
FIG. 2 is an exploded view of the board to board connector according to the invention.
Figure 3:
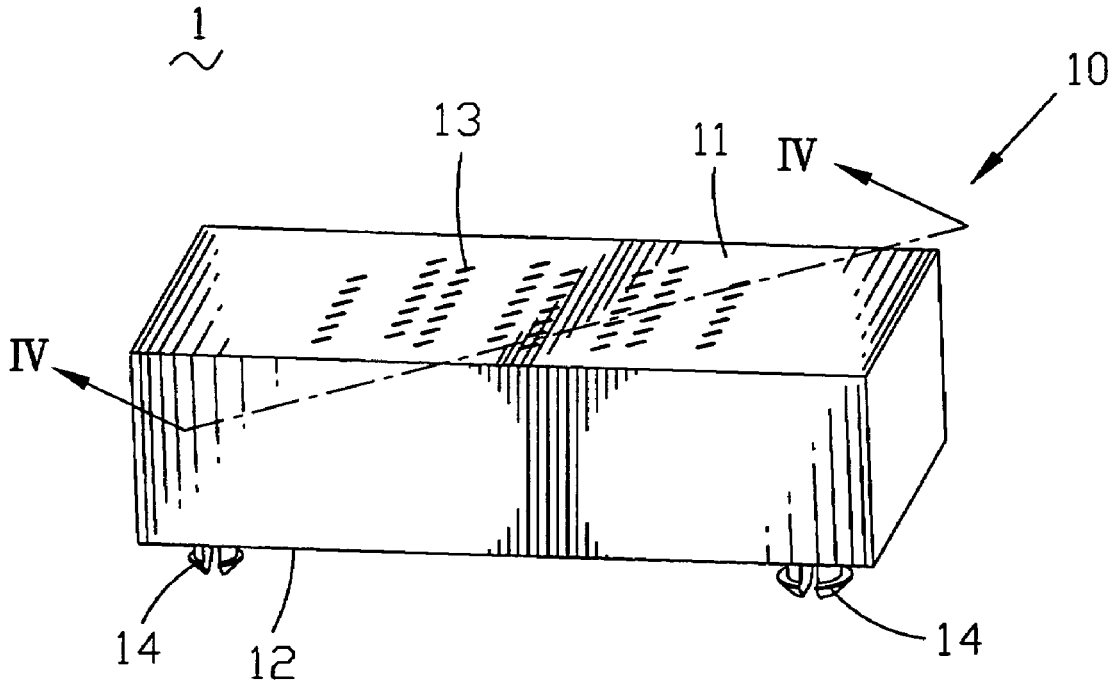
FIG. 3 is a view of a dielectric housing of the board to board connector according to the invention.
Figure 4:
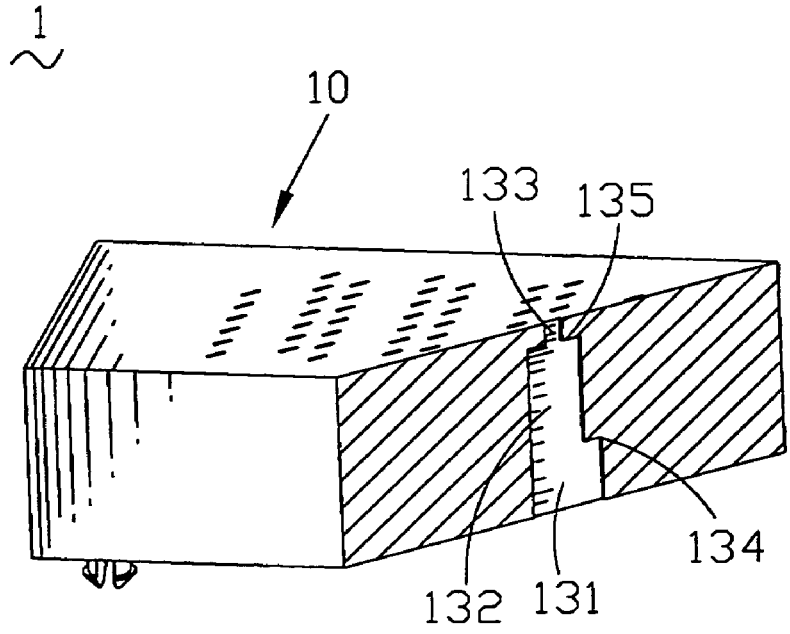
FIG. 4 is a cross-sectional view of FIG. 3 taken along □-□.

Referring to FIGS. 2, 3 and 4, the dielectric housing 10 is a cuboid. The dielectric housing 10 has an upper surface 11 and a bottom surface 12. The upper surface 11 and the bottom surface 12 are parallel. The upper surface 11 contacts with a first printed circuit board (not shown in the FIGs) and the bottom surface 12 contacts with a second printed circuit board (not shown in the FIGs). A plurality of terminal passages 13 which pass through the upper surface 11 and the bottom surface 12 are defined in the dielectric housing 10. The terminal passage 13 includes a first receiving groove 131 which communicates with the bottom surface 12. A second receiving groove 132 extends from the first receiving groove 131. A third receiving groove 133 extends from the second receiving groove 132. A first stop wall 134 is defined on the location where the first receiving groove 131 connects with the second receiving groove 132. The first stop wall 134 is parallel to the bottom surface 12, as well to the upper surface 11. Specifically, the location of the first stop wall 134 is the place where the first receiving groove 131 bridging the second receiving groove 132. A second stop wall 135 is defined on the location where the second receiving groove 132 connects with the third receiving groove 133. The second stop wall 135 is parallel to the first stop wall 134 and the location of the second stop wall 135 is the place where the second receiving groove 132 bridging the third receiving groove 133. A plurality of positional pillars 14 project downwardly from the bottom surface 12 of the dielectric housing 10. The positional pillars 14 are different in size, so as to be distinguished easily. The positional pillars 14 engage with a plurality of holes which are defined on the second printed circuit board (not show in the FIGs) respectively.

Figure 5:
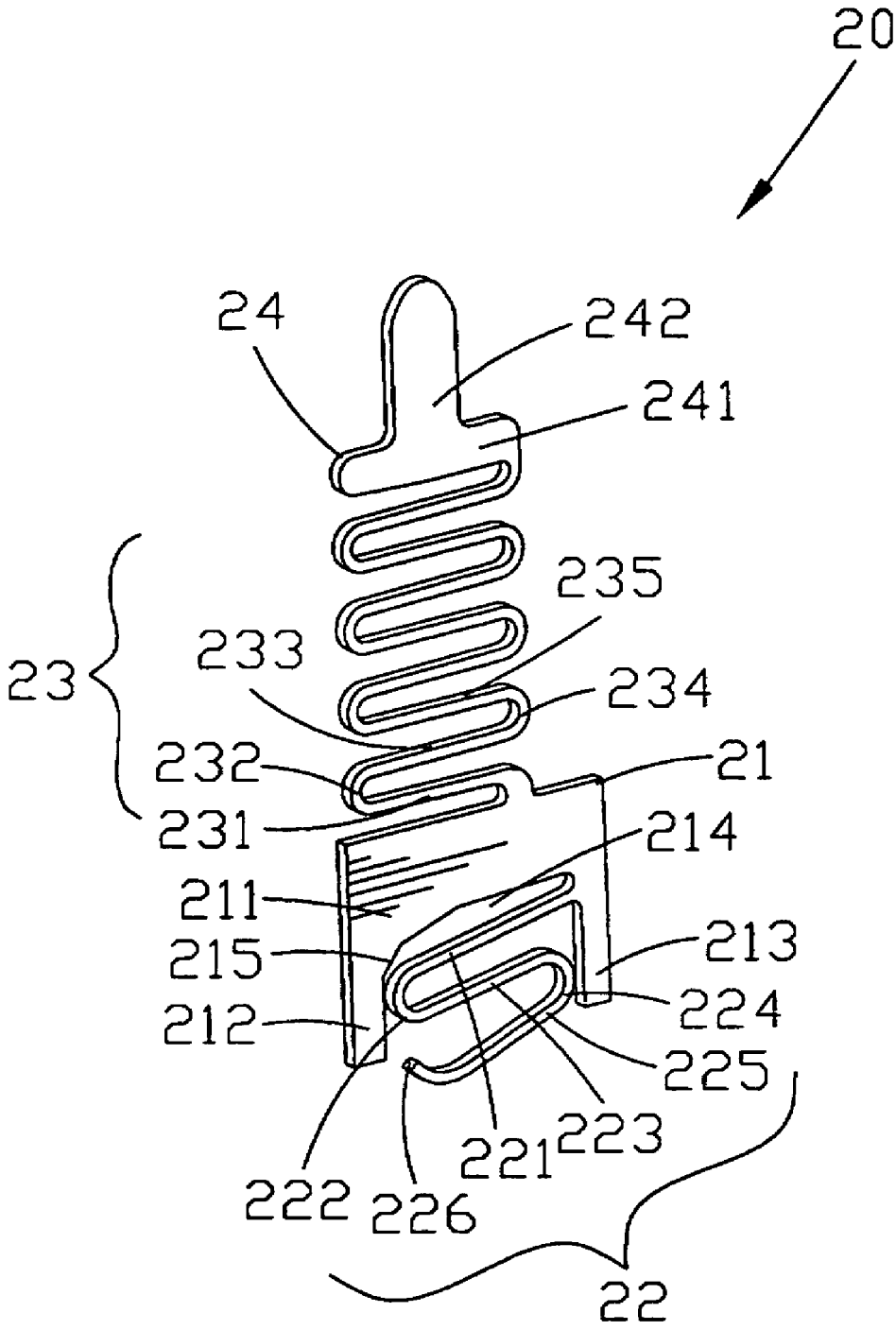
FIG. 5 is a view of a terminal of the board to board connector according to the invention.

Further referring to FIG. 5 showing the terminal arrangement of the present invention, the terminal 20 includes a fixed holding portion 21. A compressed portion 22 extends from the lower end of the fixed holding portion 21. A winding portion 23 extends from the upper end of the fixed holding portion. A first contact portion 24 extends from the top of the winding portion 23.

The fixed holding portion 21 has a base portion 211. A first fixed arm 212 and a second fixed arm 213 extend from the lateral sides of base portion 211 respectively. A notch 214 is formed among the base portion 211, the first fixed arm 212 and the second fixed arm 213. A block 215 is defined on the corner which is formed between the first fixed arm 212 and the base portion 211.

The compressed portion 22 is defined on the notch 214. The compressed portion 22 has a first elastic arm 221 which extends downwardly from the connect portion of the second fixed arm 213 and the base portion 211 to the first fixed arm 212. A first bended portion 222 extends from the end of the first elastic arm 221. The first bended portion 222 is an arc shape. A second elastic arm 223 extends from the end of the first bended portion 222 and the second elastic arm 223 is parallel to the first elastic arm 221. A second bended portion 224 extends from the end of the second elastic arm 223. The second bended portion 224 is also an arc shape but its bended direction is opposite to the first bended portion 222. A third elastic arm 225 extends from the end of the second bended portion 224. A second contact portion 226 extends from the end of the third elastic arm 225. The end of the third elastic arm 225 and the second contact portion 226 extend below the notch 214 in order to contact with a printed circuit board.

The winding portion 23 has a first elastic beam 231 which protrudes upwardly from the base portion 211. A first curving portion 232 extends upwardly from the end of the first elastic beam 231. A second elastic beam 233 extends from the end of the first curving portion 232 and is parallel to the first elastic beam 231. A second curving portion 234 extends upwardly from the end of the second elastic beam 233. The bended direction of the second curving portion 234 is opposite to the first curving portion 232. A third elastic beam 235 extends from the end of the second curving portion 234 and the third elastic beam 235 is parallel to the first elastic beam 231. And so on, a plurality of other elastic beams and curving portions are formed in the way like that.

The first contact portion 24 has a base plate 241 which extends from the end of the top elastic beam of the winding portion 23. The base plate 241 extends horizontally. The beginning side of the base plate 241 and the end side of the base plate 241 are aligned with the sides of the elastic beam of the winding portion 23 respectively. A contact point 242 extends upwardly from the middle of the base plate 241.

Figure 6:
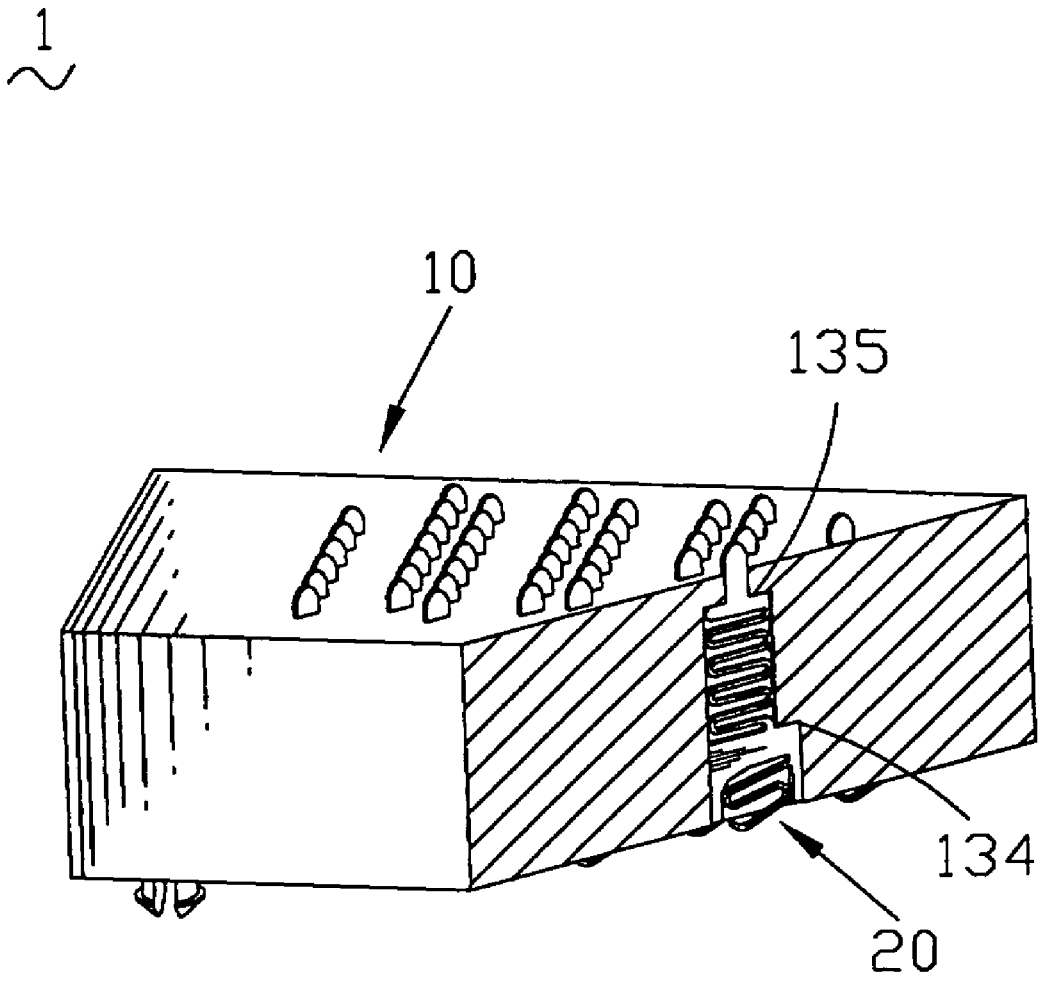
FIG. 6 is a cross-sectional view of FIG. 1 taken along VI-VI.

Please refer to FIG. 5 and FIG. 6. Each terminal 20 is received in each terminal passage 13 respectively. The fixed holding portion 21 and the compressed portion 22 are received in the first receiving groove 131 of the terminal passage 13. The upper side of the base portion 211 of the fixed holding portion 21 presses against the first stop wall 134. The end of the third elastic arm 225 and the second contact portion 226 protrude out from the bottom surface of the first receiving groove 131 so as to contact with the second printed circuit board (not show in FIGs). The winding portion 23 and the base plate 241 of the first contact portion 24 are received in the second receiving groove 132. The upper side of the base plate 241 presses against the second stop wall 135. The contact point 242 of the first contact portion 24 is received in the third receiving groove 133 and the end of the contact point 242 protrudes out from the top of the third receiving groove 133 in order to contact with the first printed circuit board (not show in FIGs).

When the board to board connector 1 engages with the printed circuit boards, the fixed holding portion 21 is received in the first receiving groove 131, the compressed portion 22 is compressed upwardly for that its second contact portion 226 receives a compressed force from the second circuit board, and the winding portion 23 is compressed downwardly for that the first printed circuit board compresses the contact point 242 of the first contact portion 24 so that the contact point 242 moves downwardly a little. When the contact point 242 contacts with the first printed circuit board and second contact portion 226 contacts with the second printed circuit board respectively and they are at a stably elastic compressed statement, the first bended portion of the compressed portion presses against the block 215.

As described hereinabove, the board to board connector 1 utilizes the contact point 242 of the terminal 20 and the second contact portion 226 of the terminal 20 to contacts with first printed circuit board and second printed circuit board respectively so as to achieve the function of the electric connection to transmit the signal. At the same time, the board to board connector 1 utilizes the elastic force which is supplied by the compressed portion 22 and the winding portion 23 to ensure that the board to board connector 1 keeps a stably elastic contacting with the printed circuit boards so as to assure the transmitting of the signal is fluent and stable. Moreover, the board to board connector 1 is easy to disassemble for it elastically contacts the printed circuit board. So, the board to board connector 1 could prevent being out of use for only one part of the board to board connector 1 is damaged. Therefore, it will cut down the cost.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A board to board connector, comprising:

a dielectric housing having an upper surface and a bottom surface, a plurality of terminal passages passing through the upper surface and the bottom surface, the terminal passages including a first receiving groove which connects with the bottom surface of the dielectric housing, a second receiving groove extending from the first receiving groove, a third receiving groove extending from the second receiving groove, a first stop wall being defined on the location where the first receiving groove connects with the second receiving groove, a second stop wall being defined on the location where the second receiving groove connects with the third receiving groove; and a plurality of terminals received in the terminal passages, each terminal having a fixed holding portion, the fixed holding portion including a base portion, a first fixed arm and a second fixed arm extending from the lateral sides of base portion respectively, a notch formed among the base portion, the first fixed arm and the second fixed arm; a compressed portion extending from the lower end of the fixed holding portion, the compressed portion including a first elastic arm which extends downwardly from the fixed holding portion, a first bended portion extending from the end of the first elastic arm, a second elastic arm which is parallel to the first elastic arm extending from the end of the first bended portion, a second bended portion extending from the end of the second elastic arm, a third elastic arm extending from the end of the second bended portion, a second contact portion extending from the end of the third elastic arm and protruding out from the bottom surface of the dielectric housing; a winding portion extending from the upper end of the fixed holding portion, the winding portion including a first elastic beam which protrudes upwardly from the top of the fixed holding portion, a first curving portion extending upwardly from the end of the first elastic beam, a second elastic beam extending from the end of the first curving portion and being parallel to the first elastic beam, a second curving portion extending upwardly from the end of the second elastic beam, a third elastic beam extending from the end of the second curving portion and being parallel to the first elastic beam; a first contact portion extending from the top of the winding portion and protruding out from the upper surface of the dielectric housing, the first contact portion including a base plate which extends from the top of the winding portion, a contact point extending upwardly from the middle of the base plate.

2. The board to board connector as claimed in claim 1, wherein the base plate is received in the second receiving groove; the upper side of the base plate presses against the second stop wall; the contact point of the first contact portion is received in the third receiving groove and the end of contact point protrudes out from the top of the third receiving groove; the winding portion is received in the second receiving groove; the fixed holding portion and the compressed portion are received in the first receiving groove; the upper side of the fixed holding portion presses against the first stop wall; the second contact portion protrudes out from the bottom of the first receiving groove.

3. The board to board connector as claimed in claim 1, further comprising plural positional pillars, protruding downwardly from the bottom surface of the dielectric housing.

4. The board to board connector as claimed in claim 1, wherein a block is defined on the corner which is formed between the first fixed arm and the base portion.

5. The board to board connector as claimed in claim 1, wherein the compressed portion is defined on the notch and extends downwardly from the connect portion of the second fixed arm and the base portion.

6. The board to board connector as claimed in claim 1, wherein the winding portion further includes a plurality of other elastic beams and curving portions which are formed in the way like the second elastic beam and the second curving portion.

7. The board to board connector as claimed in claim 1, wherein the base plate extends horizontally; the beginning side of the base plate and the end side of the base plate are aligned with the sides of the elastic beam of the winding portion respectively.

* * * * *